US006988654B2

(12) United States Patent
Wnek

(10) Patent No.: US 6,988,654 B2
(45) Date of Patent: Jan. 24, 2006

(54) CONTAINER WITH IMPROVED STACKING/DENESTING CAPABILITY

(75) Inventor: Patrick H. Wnek, Sherwood, WI (US)

(73) Assignee: Graphic Packaging International, Inc., Marietta, GA (US)

( * ) Notice: Subject to any disclaimer, the term of this patent is extended or adjusted under 35 U.S.C. 154(b) by 653 days.

(21) Appl. No.: 09/764,718

(22) Filed: Jan. 18, 2001

(65) Prior Publication Data

US 2002/0092791 A1 Jul. 18, 2002

(51) Int. Cl.
*B65D 1/40* (2006.01)

(52) U.S. Cl. ..... 229/406

(58) Field of Classification Search ..... 206/519, 206/518; 229/406
See application file for complete search history.

(56) References Cited

U.S. PATENT DOCUMENTS 1,986,824 A * 1/1935 Keiding ..... 220/DIG. 12
2,387,778 A * 10/1945 Stocking ..... 229/4.5
2,831,623 A * 4/1958 Lavigne ..... 229/406
3,836,042 A * 9/1974 Petitto ..... 206/519
4,111,303 A * 9/1978 Compton ..... 206/519
4,420,081 A * 12/1983 Dart ..... 206/519
4,832,202 A * 5/1989 Newman et al. ..... 206/217
5,105,947 A * 4/1992 Wise ..... 206/519
5,176,284 A * 1/1993 Sorensen ..... 206/519
5,721,022 A * 2/1998 Morita et al. ..... 428/34.2
6,270,003 B1 * 8/2001 Hirano ..... 229/4.5

FOREIGN PATENT DOCUMENTS

GB 609142 * 9/1948 ..... 206/519
GB 961204 * 6/1964 ..... 206/519
GB 2061699 * 5/1981

* cited by examiner

*Primary Examiner*—Stephen Castellano
(74) *Attorney, Agent, or Firm*—Womble Carlyle Sandridge & Rice, PLLC

(57) ABSTRACT

A pressed container is formed having a peripheral sidewall, a continuous bottom wall along the lower edge of the sidewall, and an outwardly directed peripheral rim along the upper edge of the sidewall and wherein an inwardly directed bulge is provided along the upper edge of the sidewall and an outwardly directed bulge is provided along the upper edge of the sidewall that cooperates with the inwardly directed bulge of an adjacent container when stacked in nesting relationship to uniformly stack the containers in nested relationship for easy separation of the containers.

29 Claims, 9 Drawing Sheets

CONTAINER WITH IMPROVED STACKING/DENESTING CAPABILITY

BACKGROUND OF THE INVENTION

1. Field of the Invention

The present invention relates generally to paperboard containers, which are pressed into a predetermined formation with a punch and die and more particularly to a container having uniquely positioned ribbing to provide uniform stacking and denesting of stacked containers.

2. Description of Relevant Art

Pressed paperboard containers have been used in numerous environments for many years with the containers having predetermined configurations and with containers of a common configuration being stackable in nested relationship with each other. Accordingly, most such containers have a downwardly and inwardly converging sidewall that is continuous with a generally flat bottom wall along its lower edge and with a flat rim along its top edge, the rim generally being substantially parallel with the bottom wall. Pressed paperboard containers can thereby be nested in an underlying container of the same configuration until a stack of a desired height is obtained. Such containers, however, do not always stack uniformly so that the rims of adjacent containers are not parallel, i.e. the rim of one container might be closer to the rim of adjacent container in one location and spaced a greater distance therefrom at a different location along its perimeter. Since these containers have an inwardly converging sidewall, even a stack of containers that are parallel will tend to wedge together upon being nested or during the transportation of stacks of containers. Accordingly, it is sometimes difficult to denest such containers as there is not a uniform spacing of the rims of adjacent containers and furthermore, the containers are frictionally engaged and wedged together so that when an uppermost container is removed from the next adjacent lower container, the next adjacent lower container is frictionally pulled with the upper container. Similarly, a partial vacuum zone may be created between containers and also inhibits denesting of a nested stack of the containers.

It would therefore be desirable to provide a container that could be uniformly stacked in a nested relationship with other containers in a manner such that the containers could be easily and individually separated during a denesting process. It is to provide a container that overcomes the above shortcomings that the present invention has been developed.

SUMMARY OF THE INVENTION

A pressed paperboard container is formed in accordance with the present invention having a downwardly convergent peripheral sidewall connected integrally along a lower edge to a bottom wall and along a top edge to a peripheral rim that projects radially outwardly. An inwardly directed bulge is provided on an inner surface of the sidewall adjacent the peripheral rim and an outwardly directly bulge is provided on the outer surface of the sidewall so that when containers are stacked in nested relationship, the inward and outward bulges are located in about the same upper section of the sidewall. The bulges create a uniform stacking of the containers with the bottom walls parallel to each other and in a manner such that the rim of each container is uniformly spaced from the rim of the next adjacent container and also create a step in the otherwise smooth sidewall, which greatly restricts containers from wedging together so that the containers can be easily separated in a denesting procedure.

Preferably, the inwardly directed bulge is provided in a ring-like manner around the sidewall and intermittently by separating the ring into a plurality of individual ribs. The bulge in the outer surface of the sidewall is also desirably formed in the same manner so as to define a ring having separated ribs. These individual ribs are created in pleats or gathered paperboard in the sidewall of the container, which pleats are the result of pre-scoring of a blank paperboard disk from which the container is formed.

Additional bulges can also be provided in the outer surface of the sidewall at downwardly spaced locations from the first bulge in the outer wall and desirably they are also formed in a ring-like manner and with individual ribs separated from each other to define a ring. The number of extra bulges may change due to the steepness of the converging sidewall and/or the depth of the container.

The ring-like bulges thereby cooperate in engaging adjacent containers in a manner to urge a uniform stacking of the containers with a substantially uniform spacing of the rims along the entire periphery of the containers and in a manner to reduce the chance of a partial vacuum being created between the containers in a stack.

Other aspects, features and details of the present invention can be more completely understood by reference to the following detailed description of a preferred embodiment, taken in conjunction with the drawings and from the appended claims.

DESCRIPTION OF THE PREFERRED EMBODIMENTS

Figure 21:
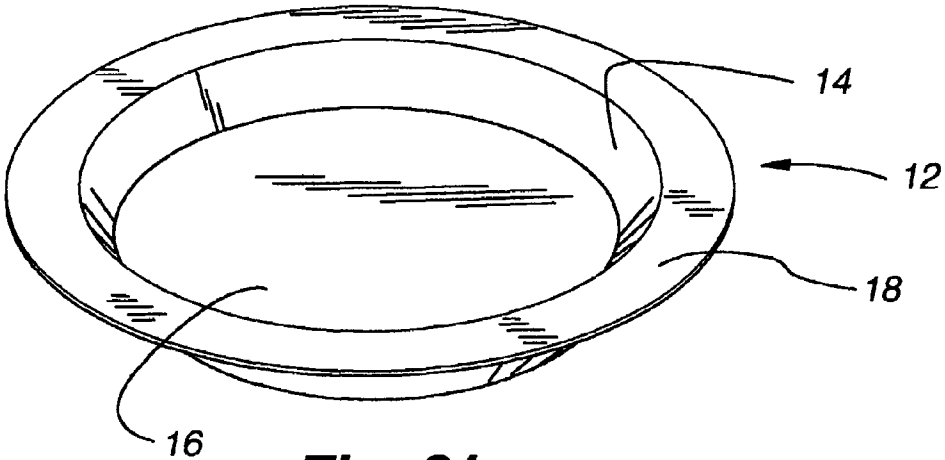
FIG. 21 is an isometric looking downwardly on a prior art circular container.
Figure 22:
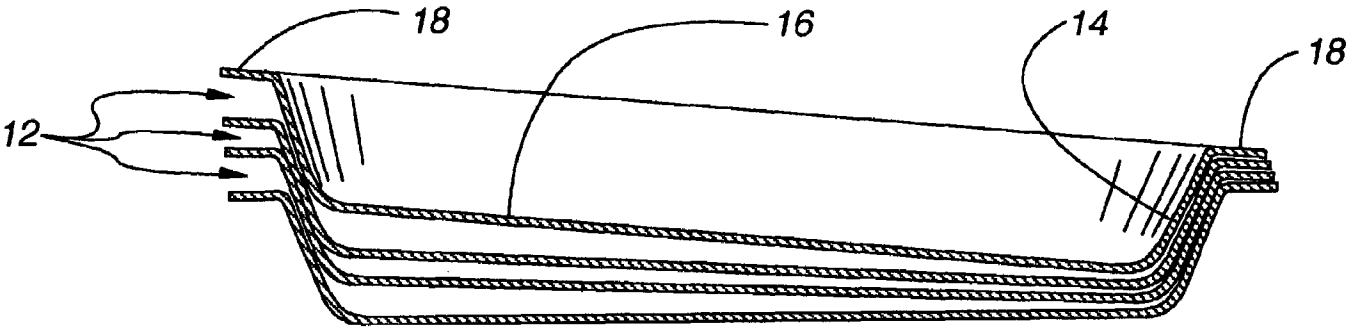
FIG. 22 is a vertical section taken through a misaligned stack of prior art containers of the type shown in FIG. 21.

Pressed paperboard containers have been made for many years by placing a sheet of paperboard with a predetermined moisture content between a punch and a die and compressing the paperboard between the punch and die into the desired form for the pressed container. Such containers have been formed in numerous configurations and for various purposes with a conventional circular pressed paperboard container 12 being shown in FIG. 21. It will there be seen that the container 12 has a downwardly convergent sidewall 14 with a substantially frustoconical configuration that is continuous with a flat bottom wall 16 along the lower edge of the sidewall and with a flat peripheral rim 18 extending radially outwardly along the upper edge of the sidewall. One problem with conventional containers of the type shown in FIG. 21 resides in the fact that they do not always stack uniformly. They might, for example, stack as shown in FIG. 22 with the rims 18 of adjacent containers not being parallel, i.e. the rim of one container being closer or even contiguous with the rim of the next adjacent container at one location while the rims of the two containers are spaced different distances at different locations along the perimeters of the containers thereby forming a misaligned stack of the containers. It is also important to note that a stacking of conventional pressed paperboard containers 12 usually results in the sidewalls 14 of the containers being frictionally engaged with the next adjacent container over relatively large areas thereby making it more difficult to separate the containers due to frictional drag and partial vacuum zones created between the containers during stacking. Further, when containers are mechanically denested, it is normal to grip or hold the uppermost container beneath the outwardly directed peripheral rim and in such instances, it is important the rims be uniformly spaced so a mechanical separator (not shown) can be uniformly applied to the rims of the containers. Obviously when the rims of the containers are not uniformly spaced, as shown in FIG. 22, a mechanical separator will not function effectively and dependably due to the non-uniform spacing between the rims of adjacent containers. Further, even if the containers in a stack are parallel but are wedged together, there will not be a strong enough force available in the mechanical separator to rapidly separate and dispense the containers on a food processing filling line.

Pressed paperboard containers, as mentioned, have various uses such as, for example, as the bottom-supporting wall for an expandable bag of microwavable popcorn. The containers might also be positioned within a popcorn tub with an expandable bag surrounding the tub. In such instances, a layer of microwave susceptor material might be disposed in the container and an expandable bag connected to or otherwise surrounding the container such that kernels of popcorn positioned in the container are desirably and uniformly heated and can expand against the expandable bag to provide the user with a convenient system for making and confining the popcorn.

Figures 1, 2:
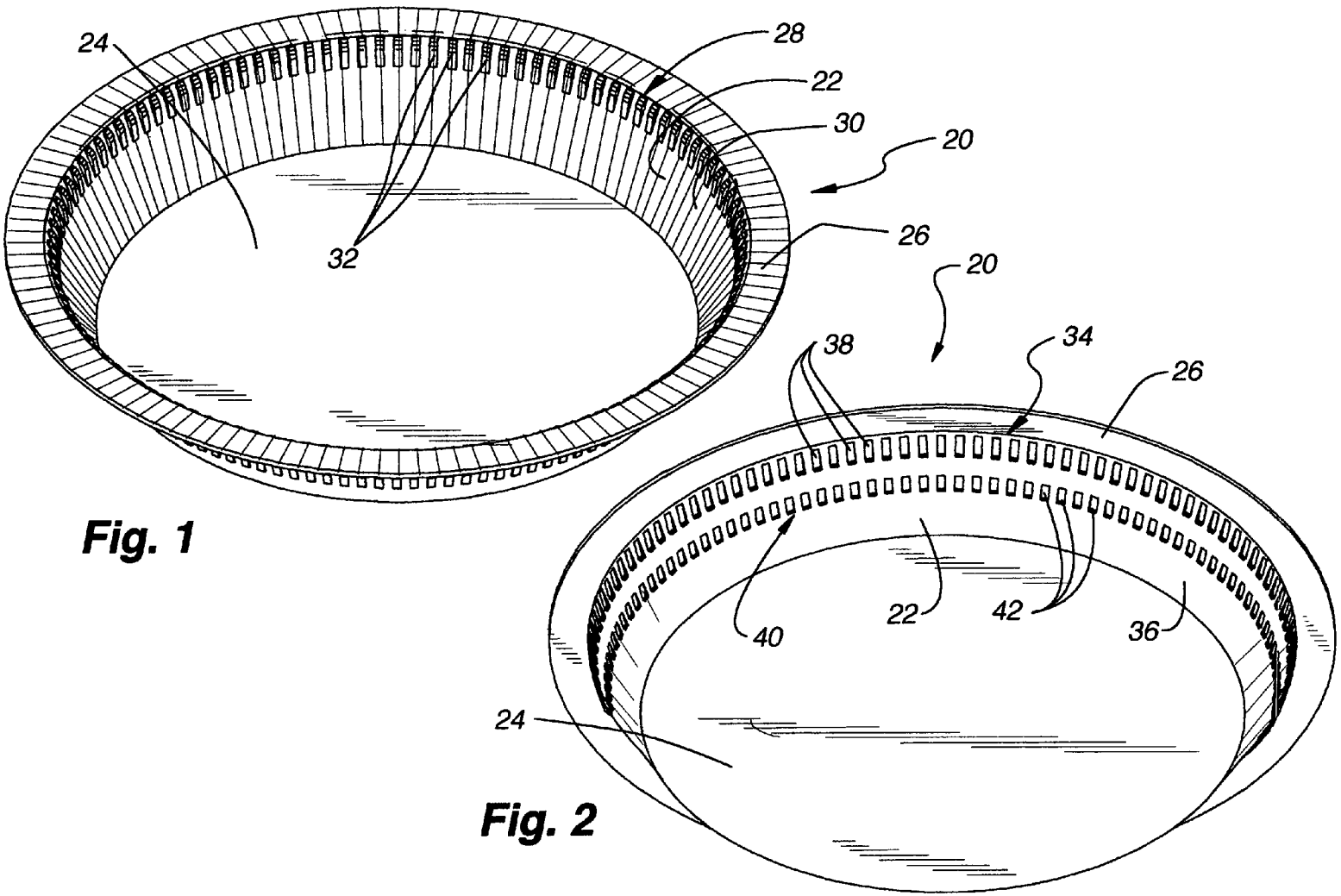
FIG. 1 is an isometric looking downwardly on a circular container formed in accordance with the present invention.
FIG. 2 is an isometric similar to FIG. 1 looking upwardly on the container of FIG. 1.

Referring to FIGS. 1 and 2, a container 20 formed in accordance with the present invention is illustrated. As will be appreciated, the container has a downwardly convergent, generally frustoconical sidewall 22 that is continuous along its circular lower edge with a flat bottom wall 24 and along a circular upper edge with an outwardly directed flat peripheral rim 26. In the disclosed embodiment of the pressed paperboard container, the rim 26 and bottom wall 24 are substantially parallel, but that is not necessarily necessary to a compressed container that functions in accordance with the principles of the present invention.

Figure 6:
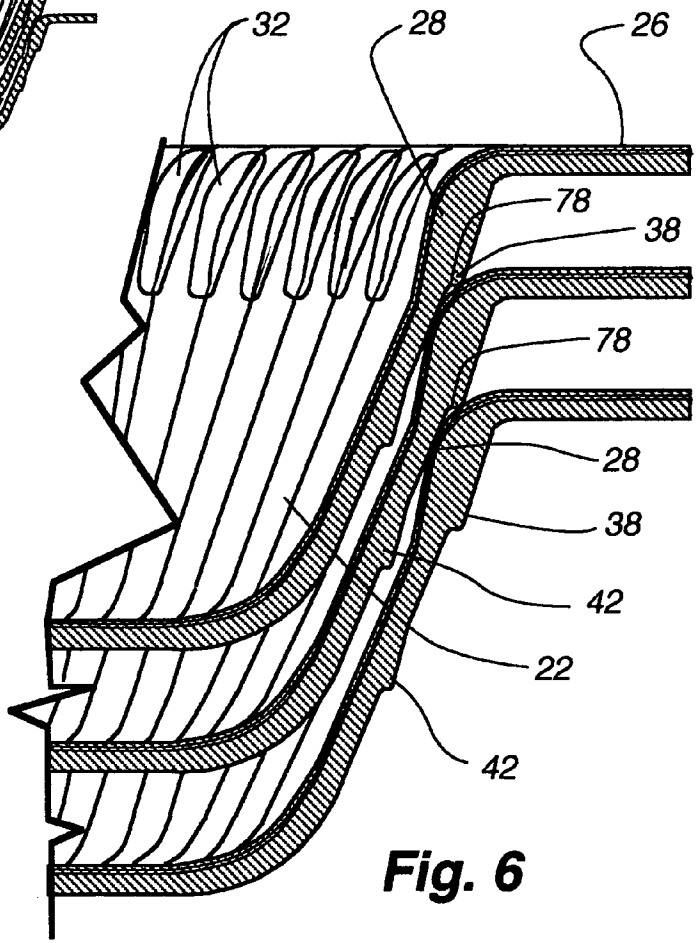
FIG. 6 is an enlarged fragmentary vertical section taken through the right-hand side of the stack of containers as shown in FIG. 5.

The container 20 is provided with a ring-like bulge 28 that projects inwardly from the inner surface 30 of the sidewall 22 immediately adjacent to the peripheral rim 26 with the ring-like bulge being provided in the form of a plurality of vertically extending and uniformly spaced ribs 32. As best seen in FIGS. 2 and 6, the sidewall 22 also has a ring-like bulge 34 projecting outwardly from the outer surface 36 of the sidewall with the outwardly directed ring-like bulge also being formed from a plurality of vertically extending and uniformly spaced ribs 38. The inner and outer surfaces of the sidewall define a sidewall thickness therebetween with the sidewall thickness of the bulges at said ribs being greater than between adjacent ribs and at other locations on the sidewall.

As is probably best appreciated by reference to FIG. 6, the ring of ribs 38 projecting outwardly from the outer surface 36 of the sidewall 22 is horizontally aligned with a lower portion of the inwardly directed ribs 32 on the inner surface 30 of the sidewall for a purpose that will become clearer later.

As best seen in FIGS. 2 and 6, the outer surface 36 of the side wall 22 also has a lower ring-like bulge 40 in the form of a plurality of vertically oriented and circumferentially spaced ribs 42, which are spaced downwardly from both the inwardly directed ring-like bulge 28 on the inner surface of the sidewall and the upper ring-like bulge 34 on the outer surface of the sidewall. While more than one lower ring-like bulge may be utilized, only one has been illustrated and described.

The containers are preferably formed in a two-step process. In the first step of the process, a flat radially scored disk 39 is formed from a flat circular disk 41 shown in dashed lines in FIG. 7. The disk 41 is positioned in a scoring apparatus 43 having an upper scoring plate 45 and a lower back-up plate 47. The upper scoring plate, as best seen in FIGS. 7, 8, 11, 12, and 15, can be circular in configuration having a plurality of radially directed blades 49 positioned in a ring-like zone adjacent to the perimeter of the scoring plate. The back-up plate is a generally flat plate having a circular recess 51 formed therein conforming in size to the blank disk 41 from which a container is to be made with the circular recess having a plurality of radial grooves 53 aligned with and substantially corresponding in cross-sectional size and length with the blades 49 on the scoring plate. The circular blank disk 41 from which the container is to be made is positioned in the circular recess 51 of the back-up plate, and the scoring plate is pressed against the top surface of the material so as to score the material along lines 57 by forming radial depressions 53 (FIG. 12) in the top surface and corresponding radial protrusions 55 (FIG. 12) in the bottom surface as the radial blades force the disk 41 into the radial grooves 53 of the back-up plate.

Figure 3:
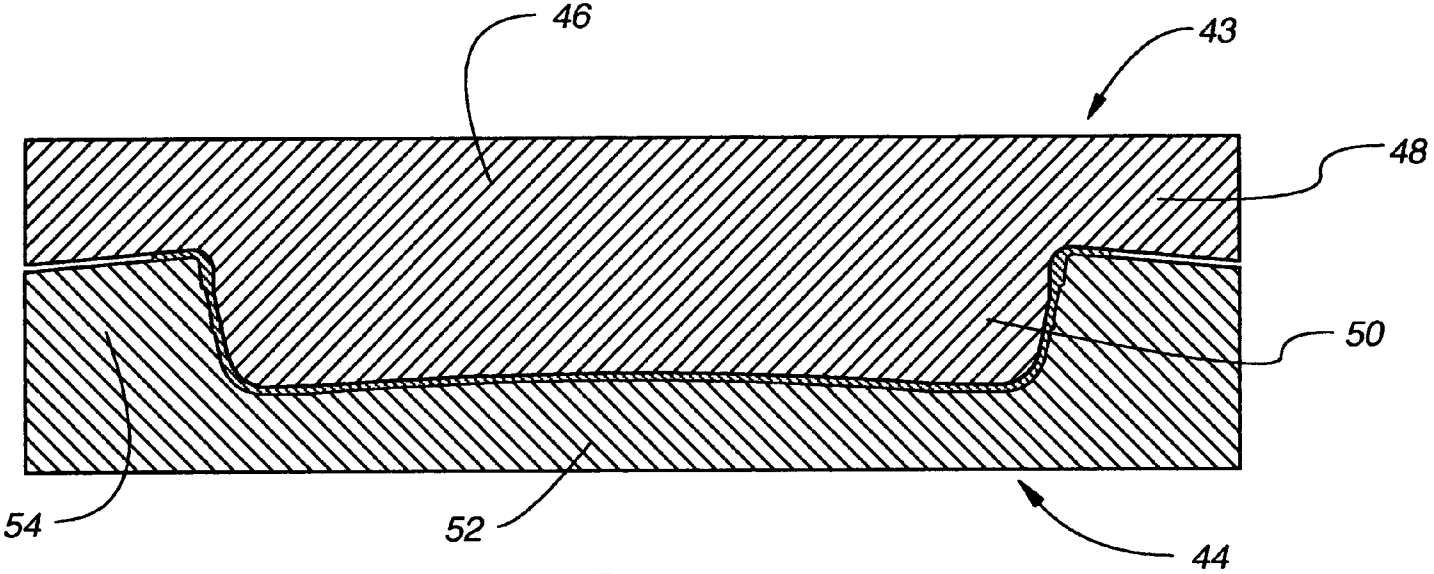
FIG. 3 is a vertical section taken through a press and die for forming the container of FIG. 1.
Figure 17:
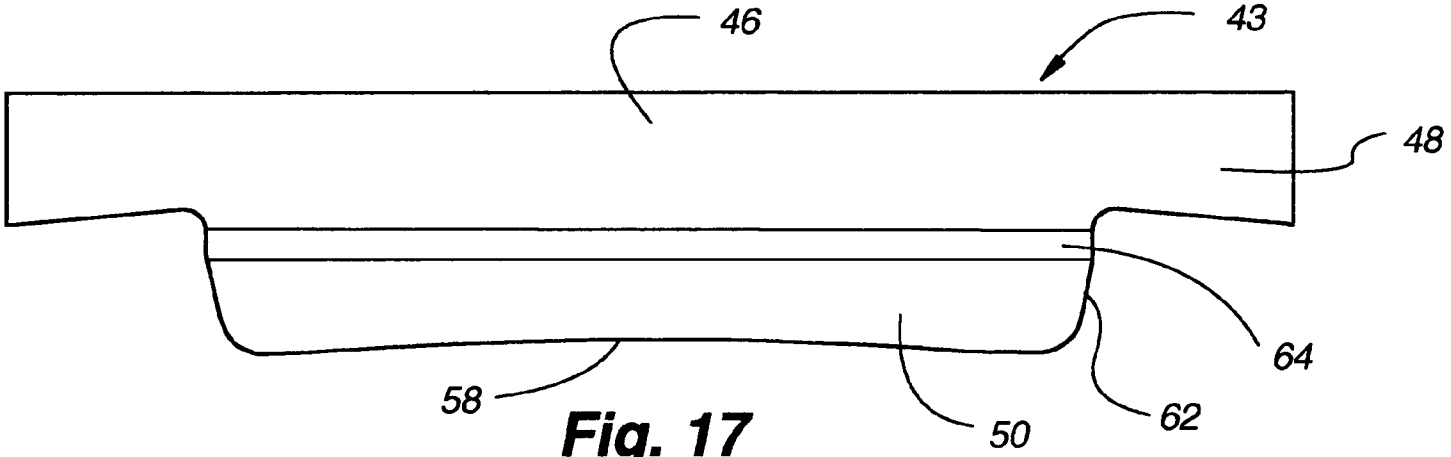
FIG. 17 is a side elevation of the punch used in forming the container of FIG. 1.
Figure 18:
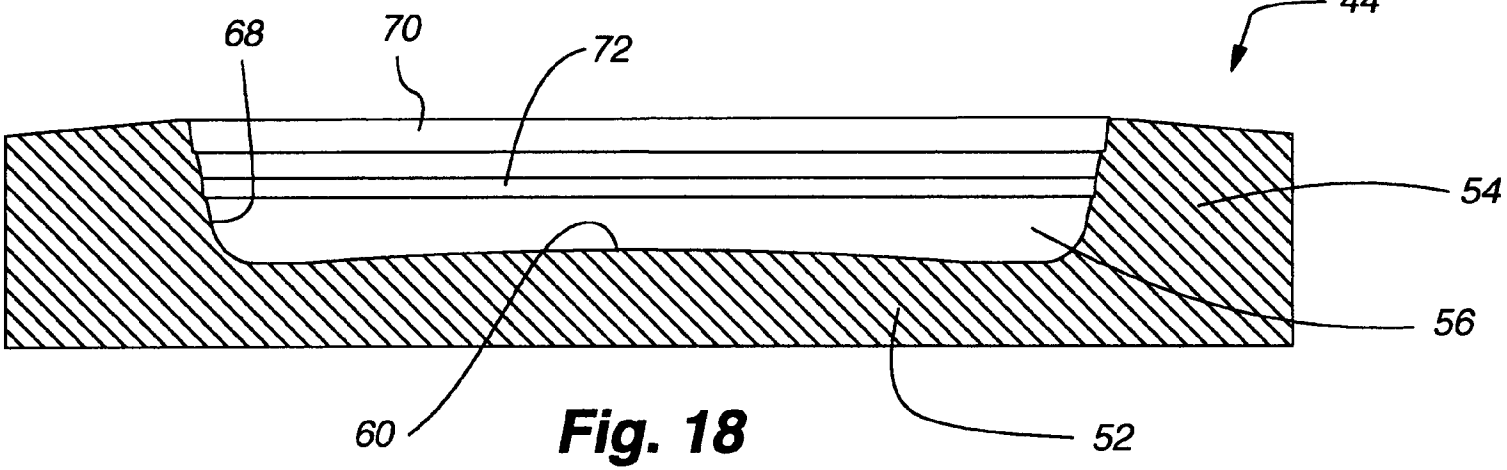
FIG. 18 is a vertical section taken through the die used to form the container of FIG. 1.

In a second step of the process for forming the containers, the radially scored disk 39 from which the container is to be made is formed into the desired configuration of the container with a punch 43 and die 44 as shown in FIGS. 3, 17, and 18 with the punch, i.e. the male component, having an upper main body portion 46 defining a peripheral flange 48 with a central generally frustoconical downward projection 50 and with the die, i.e. the female portion, having a main body 52 defining a peripheral flange 54 and a centrally located generally frustoconically shaped depression 56 that is somewhat complementary with the downward projection 50 of the punch. The downward projection of the punch has a concave bottom wall 58 that is complementary with a convex top wall 60 of the depression in the die so that when paperboard from which the containers are being formed is being compressed therebetween, the bottom wall 24 of the container is upwardly convex but will straighten out into a flat bottom wall when the paperboard dries after having been formed. The frustoconical sidewall 62 of the downward projection of the punch is substantially smooth but has an inwardly directed ring-like relief groove 64 (FIG. 17) adjacent to the juncture between the frustoconical sidewall 62 of the punch and its peripheral flange 48. The relief groove 64 is a uniform continuous circular relief cut of arcuate cross section into punch 43. It creates the inwardly directed ribs 32 out of the scored areas of the container. In other words, as the container is being formed from a pre-scored blank disk 39 between the punch and die, the radial depressions 53 in the paperboard define weakened areas that expand into the circular relief cut 64 as the punch is advanced into the die thereby forming the ribs 32. The ribs are spaced just as the radial depressions 53 are spaced due to the scoring process.

The substantially frustoconically shaped sidewall 68 of the depression 56 in the die 44 is also a substantially smooth surface that is provided with two ring-like relief grooves 70 and 72 (FIG. 18), which are uniform continuous circular reliefs of arcuate cross section cut into die 44. They create the outwardly directed ribs 38 and 42 along the radial protrusions 55 of the scored areas of the container just as the ribs 32 are formed from the radial depressions 53 as described above.

It is important that the grooves 64 and 70 be located in the same upper region of the sidewall. This results in the creation of the double bulge required to create a desired nesting step in the otherwise smooth sidewall.

As can be seen in FIG. 3, when a flat, scored disk 39 of paperboard is positioned between the punch and die, and the punch and die are moved into confronting, pressed relationship, the ring-like bulges in the sidewall are consistently formed. Further, the peripheral flange 48 of the punch and the complementary peripheral flange 54 of the die are tapered outwardly and downwardly so that the rim of the compressed container is initially formed to slope outwardly and downwardly. When the paperboard material dries, however, after the pressed paperboard container 20 has been removed from the punch and die, the rim will assume a horizontal orientation in substantially parallel relationship with the bottom wall.

Figure 4:
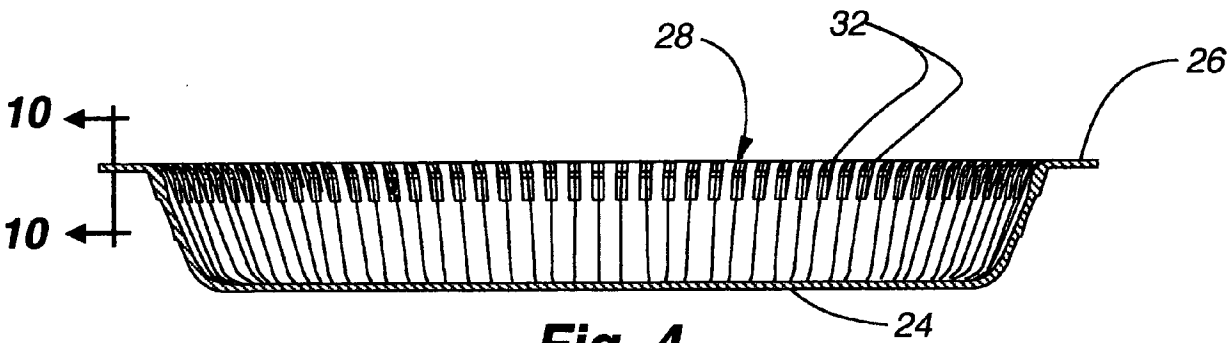
FIG. 4 is a longitudinal vertical section taken through the center of the container of FIG. 1.

As can be seen in FIGS. 1 and 4, the rim of a container also includes score lines 57 but during the pressing process there are no relief grooves in the rim areas of the punch and die into which the radial depressions 53 on the top surface of the material and the radial protrusions 55 on the bottom surface can expand. Accordingly, the top surface of the material having the radial depressions becomes pleated at 59 (FIG. 10) as it is compressed between the flat punch and die, and the bottom surface actually buckles inwardly at 61. Accordingly, the top and bottom surfaces of a rim of a completed container are somewhat flat even though the top surface is defined by a plurality of pleated areas and the bottom surface is defined by a number of buckled areas.

Figure 5:
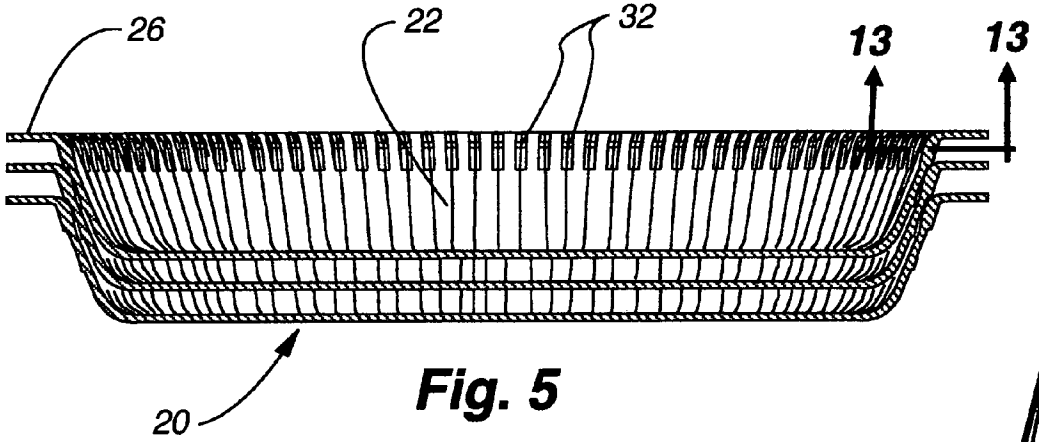
FIG. 5 is a vertical section taken through a stack of containers of the type shown in FIG. 1.

With the containers formed as described above, they can be uniformly stacked in nested relationship as shown best in FIGS. 5 and 6. As probably best seen in FIG. 6, an outwardly directed rib 38 on the upper ring-like bulge of one container is positioned to rest upon and engage an inwardly directed rib 32 of the next adjacent lower container. The inwardly directed rib 32 of a lower container also fits into a notch 78 defined beneath a rib 38 of the next adjacent upper container so that the containers are encouraged to stack uniformly and with a uniform spacing between the peripheral rims 26 of adjacent containers. The containers will also not tend to easily wedge together due to the step that is created in the otherwise smooth sidewall. The step is necessary to prevent containers from wedging when initially stacked and greatly reduces the wedging of stacks of containers when they are being transported. The spacing between rims of adjacent containers can be controlled by the size and positioning of the inwardly directed ring-like bulge 28, and the upper outwardly directed ring-like bulge 34.

While the lower ring-like bulge 40 is not always necessary, it has been found that providing such a bulge further encourages adjacent containers to stack uniformly. As will be appreciated best by reference to FIG. 6, if one container were to become slightly inclined relative to the next adjacent lower container, the lower outwardly directed ring-like bulge 40 would engage the inner surface 30 of the next adjacent lower container to prevent further tilting of the container in that direction.

Accordingly, the system of inwardly and outwardly directed bulges provided on the sidewalls of the pressed paperboard containers enables the containers to be stacked uniformly with the bottom wall of each container parallel and more importantly with the peripheral rims of each container also being parallel and uniformly spaced without wedging so that one container can easily be separated from the next adjacent container by manually or mechanically removing a container from an adjacent container.

It will also be appreciated by reference to FIG. 6 that the sidewalls 22 of the containers are only engaged along small ring-like areas of engagement so there is very little frictional resistance to removal of one container from the next adjacent container in a stack. Further, the rings of bulges actually consist of a plurality of individual vertically extending ribs having a non-bulge spacing, which provides an air vent or an air gap therebetween that prevents a partial vacuum from being formed between containers, which would otherwise resist the separation of one container from the next adjacent container.

Figure 10:
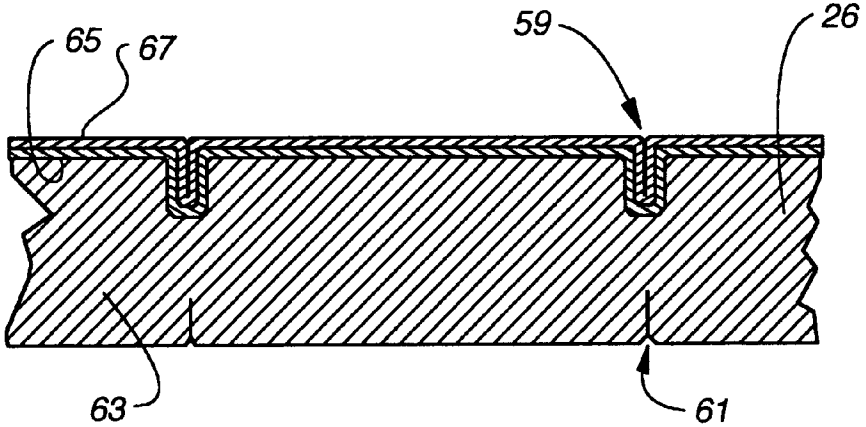
FIG. 10 is an enlarged fragmentary section taken along line 10—10 of FIG. 4.
Figure 12:
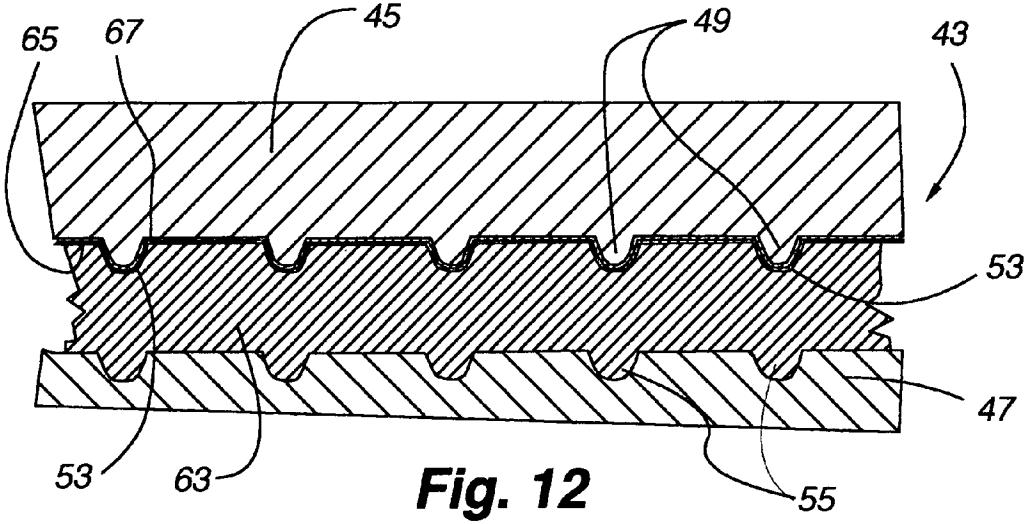
FIG. 12 is an enlarged fragmentary section taken along line 12—12 of FIG. 11.
Figure 15:
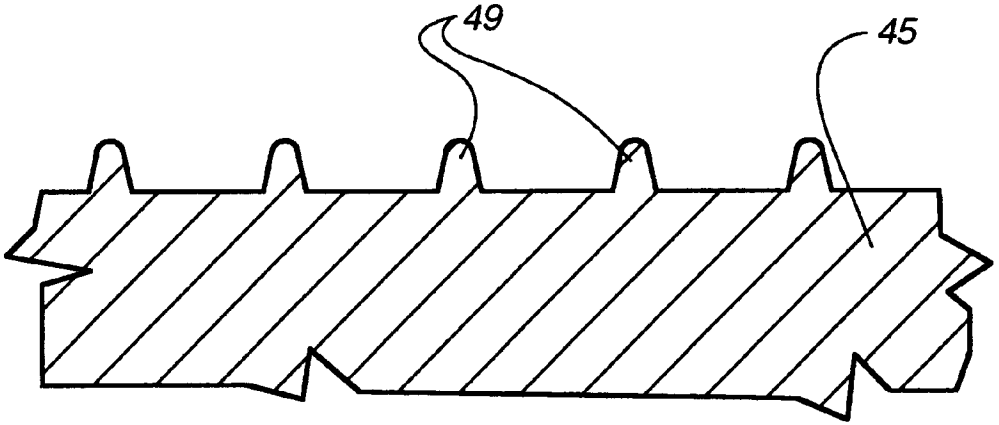
FIG. 15 is an enlarged fragmentary section taken along line 15—15 of FIG. 8.
Figure 16:
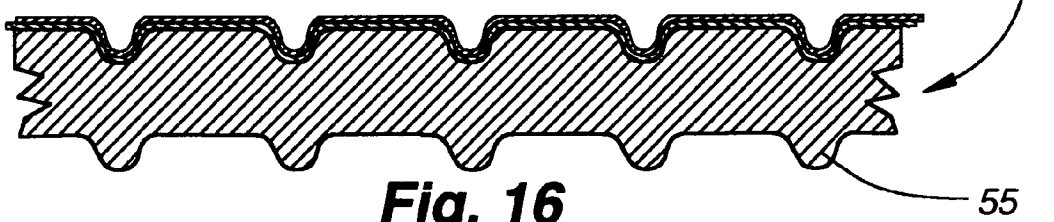
FIG. 16 is an enlarged fragmentary section taken along line 16—16 of FIG. 9.
Figure 14:
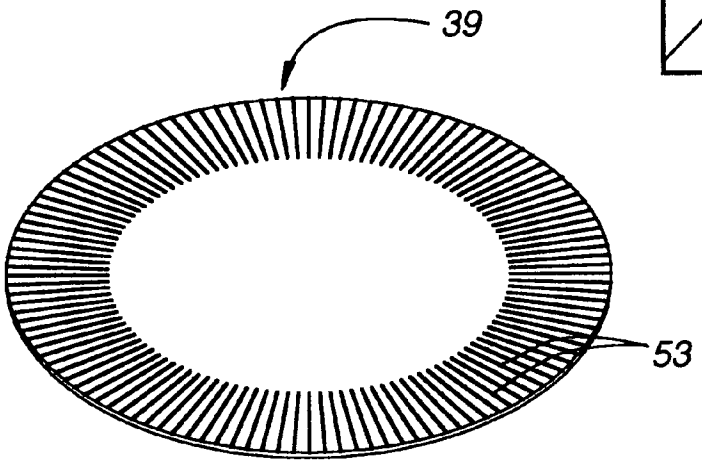
FIG. 14 is an isometric view of a scored disk used in forming the container of FIG. 1.

As mentioned previously, each container is formed from a flat, blank, circular disk 41 of material that might simply be paperboard or in the case of a container to be used in a microwavable popcorn bag, the material could be a laminate. The laminate, as shown in FIGS. 10 and 12, would preferably have a lower paperboard layer 63 adhesively bonded to an overlying susceptor layer 65 that converts microwave energy into heat with the susceptor layer being adhesively bonded to an overlying layer of paper 67. The flat circular laminate disk 41 from which a container is to be pressed would also be radially scored in the paper surface as described above with the radial score lines 57 being circumferentially spaced and only provided along an outer ring-like zone of the disk that corresponds to the area that ultimately becomes the sidewall and rim of the container. The score lines 57 (seen in FIGS. 1, 4, 5, 6, and 8) serve to weaken the paperboard structure so that when the container is formed in the punch and die, the circular scored zone allows the sidewall and rim area of the disk to be collapsed slightly upon itself on the top surface (FIG. 10) as it is reduced in area and circumference during formation of the container creating minor pleat-like areas on the inner surface of the sidewall 22 and top surface of the rim 26. These scored and weakened areas actually bulge out into the grooves 64, 70, and 72 creating the desired separation features, i.e. ribs, of the container.

Further, while those skilled in the art are fully capable of determining processing conditions for properly forming such pressed paperboard containers, when forming a pressed container from a laminate as described above, it is desirable that the punch temperature be in the range of 110° to 115° centigrade, the die temperature in the range of 165° to 175° centigrade, a forming die force in the range of 15000 to 16000 pounds and the closed dwell time of the punch in the die approximately 1.2 seconds. Further, it is preferable that a smooth side of the paperboard should be on the outside bottom of the container and the moisture content of the paperboard be in the range of 4.5% to 6.5% regardless of whether the paperboard is the sole material from which the container is punched or whether it is part of a laminate. It is also necessary to provide an air eject system (not shown) in the female die to overcome the resistance of the bulges as the formed container is leaving the die and such is well known in the art.

Figures 7, 8, 9:
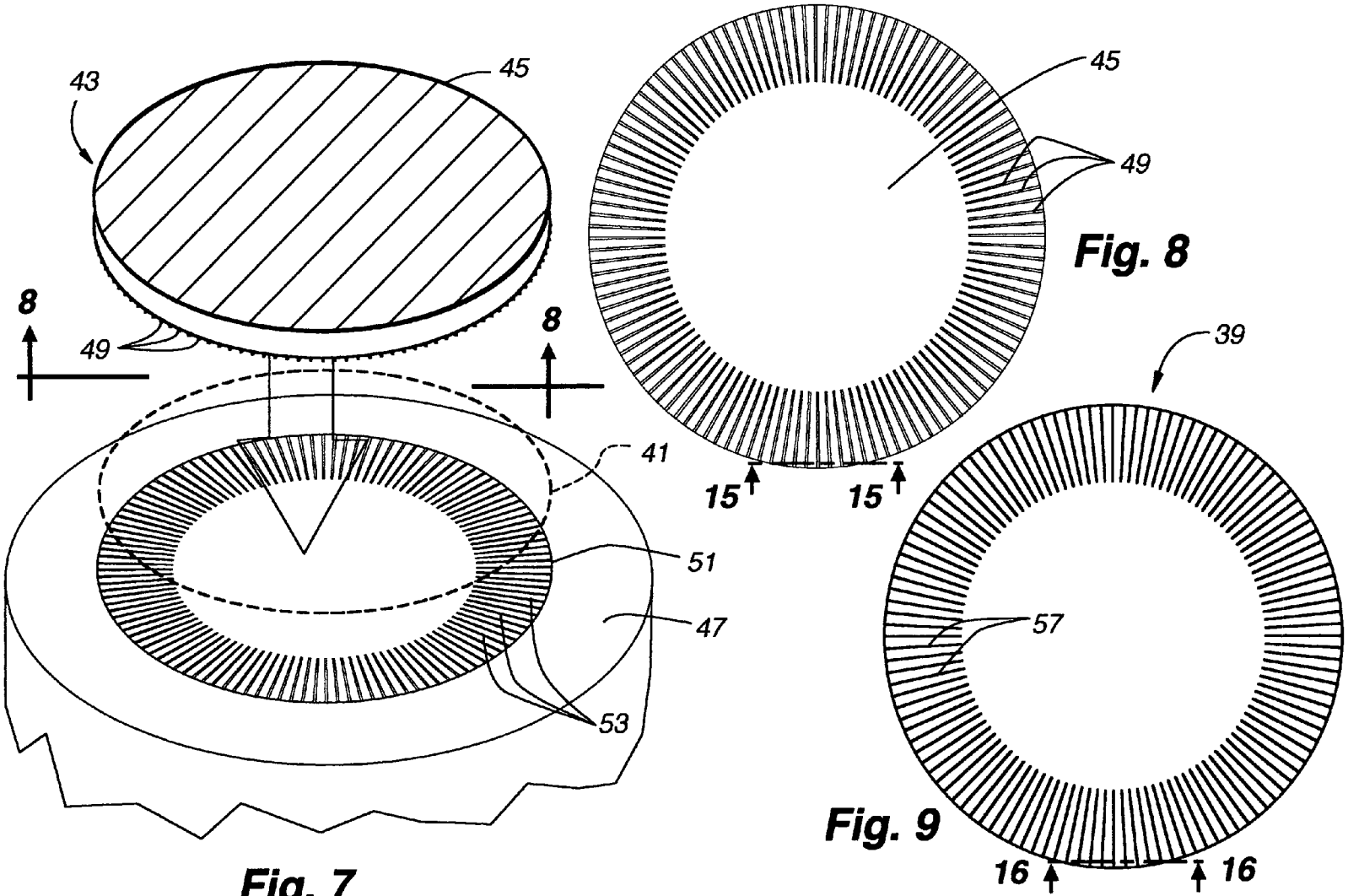
FIG. 7 is a fragmentary diagrammatic isometric showing an apparatus for scoring a blank used in making the container of FIG. 1.
FIG. 8 is a plan view looking upwardly at the scoring plate shown in FIG. 7.
FIG. 9 is a top plan view of a pre-scored blank of material from which the container of FIG. 1 is formed.
Figure 13:
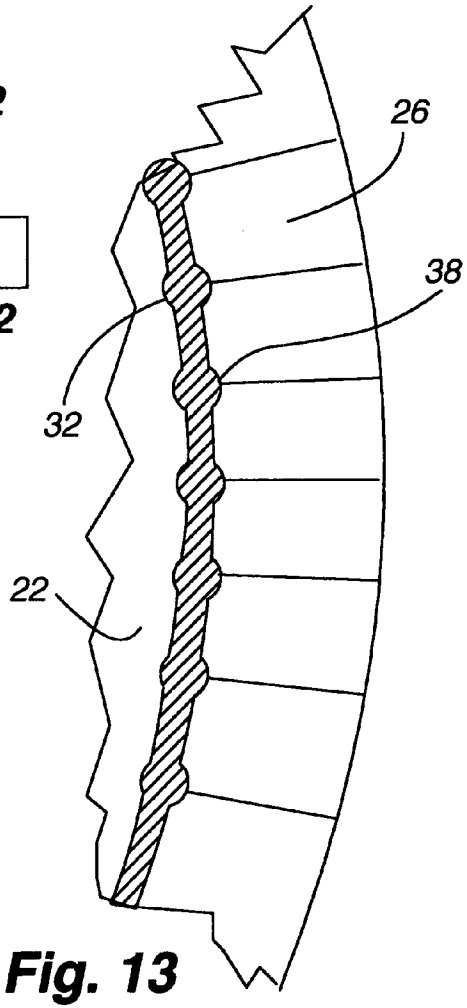
FIG. 13 is an enlarged fragmentary section taken along line 13—13 of FIG. 5.
Figure 11:
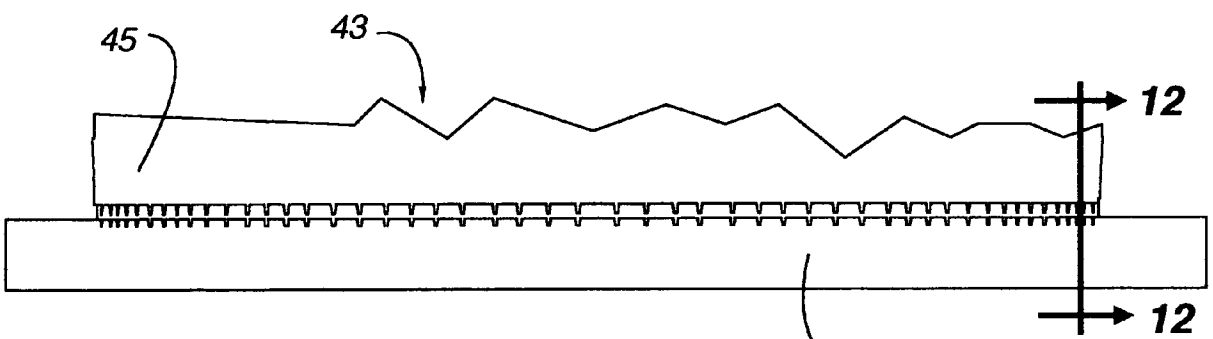
FIG. 11 is a diagrammatic fragmentary side elevation of the apparatus shown in FIG. 7 for scoring a blank disk from which the container of FIG. 1 is formed.

With reference to FIGS. 7 and 8, a container 80 of rectangular configuration is illustrated that has been formed in accordance with the present invention. As will be appreciated, it has the same desirable qualities for stacking and denesting purposes as the aforedescribed circular container.

Figures 19, 20:
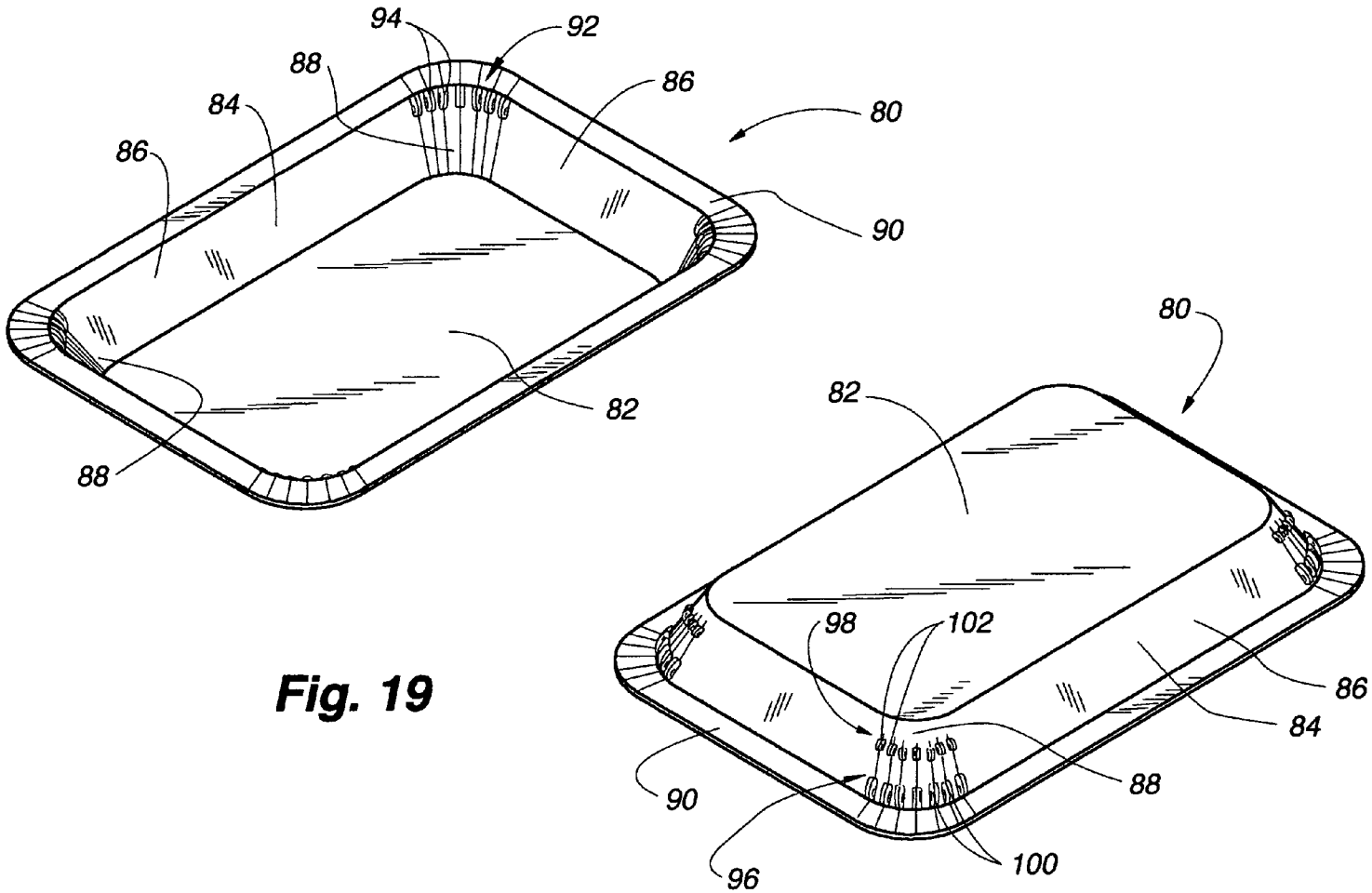
FIG. 19 is an isometric looking downwardly on a rectangular container formed in accordance with the present invention.
FIG. 20 is an isometric similar to FIG. 19 looking at the bottom of the container shown in FIG. 19.

The container 80, shown in FIGS. 19 and 20 has a rectangular bottom wall 82 with an upwardly and outwardly diverging sidewall 84 that is continuous with the bottom wall so as to form four flat sidewall segments 86 that are spaced by curved corners 88 of the sidewall. A continuous flat flange 90 projects peripherally and outwardly from the upper edge of the sidewall and is substantially parallel with the bottom wall. The container is formed with an inwardly directed bulge 92 (as described previously) along the upper edge of each curved corner with the bulge being defined by a plurality of vertically extending and uniformly horizontally spaced ribs 94 formed along score lines provided in the corners of a rectangular blank from which the container is formed. Upper and lower outwardly directed bulges 96 and 98, respectively, are also formed in the curved comers and are defined by vertically extending and uniformly spaced ribs 100 and 102, respectively. The upper bulge 96 of outwardly directed ribs is adapted to cooperate with the inwardly directed ribs 94 of a next adjacent container in a stack and the lower bulge 98 of outwardly directed ribs is provided to further assist in assuring that containers are uniformly stacked with the outwardly directed rims of adjacent containers being parallel and uniformly spaced as described previously.

Although the present invention has been described with a certain degree of particularity, it is understood that the present disclosure has been by way of example, and changes in detail or structure may be made without departing from the spirit of the invention as defined in the appended claims.

What is claimed is:

1. A paperboard nestable container, comprising:

a continuous sidewall with inner and outer surfaces defining a sidewall thickness therebetween and upper and lower edges; and a bottom wall formed along said lower edge of the sidewall, said sidewall being downwardly convergent and having a bulge projecting inwardly from said inner surface of the sidewall, said sidewall also having at least one bulge projecting outwardly from the outer surface of said sidewall, said thickness of the sidewall being greater at at least some locations along said bulges than at other locations on said sidewall, said at least one outwardly projecting bulge adapted to cooperate with the inwardly directed bulge of an underlying nested container to encourage aligned stacking of the containers, wherein said container is press-formed from a single substantially flat blank, the blank being substantially comprised of a paperboard material, and said sidewall comprising a plurality of pleats extending up the sidewall created by folds in the blank.

2. The container of claim 1 wherein said inwardly projecting bulge is ring-like.

3. The container of claim 2 wherein said at least one outwardly directed bulge is ring-like.

4. The container of claim 3 wherein said inwardly and said at least one outwardly directed bulges including a plurality of peripherally spaced ribs which define locations in said sidewall which have a greater sidewall thickness than other locations on said sidewall.

5. The container of claim 3 wherein said container further includes a peripheral rim projecting outwardly from said upper edge of said sidewall.

6. The container of claim 5 wherein said inwardly projecting bulge is adjacent to said upper edge of said sidewall.

7. The container of claim 6 wherein said at least one outwardly projecting bulge is horizontally aligned with said inwardly projecting bulge.

8. The container of claim 7 wherein said peripheral rim is substantially parallel with said bottom wall of the container.

9. The container of claim 3 further including a second outwardly projecting bulge on said sidewall positioned beneath said at least one outwardly projecting bulge.

10. The container of claim 9 wherein said second outwardly projecting bulge is ring-like.

11. The container of claim 10 wherein said second outwardly projecting bulge includes a plurality of peripherally spaced ribs which define locations in said sidewall which have a greater sidewall thickness than other locations on said sidewall.

12. The container of claim 7 further including a second outwardly projecting bulge on said sidewall positioned beneath said at least one outwardly projecting bulge.

13. The container of claim 1 wherein said container is made of a material that is a laminate that further includes a microwave susceptor layer.

14. The container of claim 1, wherein the blank includes a plurality of score-lines whereat the blank folds to form the sidewall.

15. The container of claim 1 wherein said at least one outwardly projecting bulge is horizontally aligned with aid inwardly projecting bulge.

16. The container of claim 1 wherein said upper edge of said sidewall defines an opening of the container, and said opening is wider than said bottom wall.

17. A paperboard nestable container comprising:

a continuous sidewall with inner and outer surfaces defining a upper and lower edge of the sidewall; and a bottom wall formed along said lower edge of the sidewall, said sidewall being downwardly convergent and having a bulge projecting inwardly from said inner surface of the sidewall, said sidewall also having at least one bulge projecting outwardly from the outer surface of said sidewall, said at least one outwardly projecting bulge and said at least one inwardly directed bulge each having bottom edges.

the bottom edges of the at least one outwardly projecting bulge and the bottom edges of the at least one inwardly projecting bulge being located on the sidewall at substantially the same vertical distance from the bottom wall, wherein said container is press-formed from a single substantially flat blank, the blank being substantially comprised of a paperboard material, and said sidewall comprising a plurality of pleats extending up the sidewall created by fold in the blank.

18. The container of claim 17, wherein the blank includes a plurality of score-lines whereat the blank folds to form the sidewall.

19. The container of claim 17 wherein said at least one outwardly projecting bulge is horizontally aligned with said inwardly projecting bulge.

20. The container of claim 17 said inwardly and said at least one outwardly directed bulges include a plurality of peripherally spaced ribs extending up the sidewall which define locations in said sidewall which have a greater sidewall thickness than other locations on said sidewall.

21. The container of claim 17 wherein said container further includes a peripheral rim projecting outwardly from said upper edge of said sidewall.

22. The container of claim 17 wherein said upper edge of said sidewall defines an opening of the container, and said opening is wider than said bottom wall.

23. A paperboard nestable container, comprising;

a sidewall with inner and outer surfaces defining a sidewall thickness therebetween and upper and lower edges;

a bottom wall formed along said lower edge of the sidewall; and a peripheral rim projecting outwardly from said upper edge of aid sidewall, said sidewall being downwardly convergent and having a ring-like bulge projecting inwardly from said inner surface of the sidewall, said sidewall also having at least one ring-like bulge projecting outwardly from the outer surface of said sidewall, wherein said container is press-formed from a blank being substantially comprised of a paperboard material, said inwardly and said at least one outwardly directed bulges including a plurality of peripherally spaced ribs extending up the sidewall which define locations in said sidewall which have a greater sidewall thickness than other locations on said sidewall, and said sidewall comprising a plurality of pleats extending up the sidewall created by folds in the blank.

24. The container of claim 23 wherein said inwardly projecting bulge is adjacent to said upper edge of said sidewall.

25. The container of claim 23 wherein said at least one outwardly projecting bulge is horizontally aligned with said inwardly projecting bulge.

26. The container of claim 23 wherein said peripheral rim is substantially parallel with said bottom wall of the container.

27. The container of claim 23 further including a second outwardly projecting bulge on said sidewall positioned beneath said at least one outwardly projecting bulge.

28. The container of claim 23 wherein said container is made of a material that is a laminate that further includes a microwave susceptor layer.

29. The container of claim 23 wherein said upper edge of said sidewall defines an opening of the container, and said opening is wider than said bottom wall.

* * * * *